US009472168B2

(12) United States Patent
Holland et al.

(10) Patent No.: US 9,472,168 B2
(45) Date of Patent: Oct. 18, 2016

(54) DISPLAY PIPE STATISTICS CALCULATION FOR VIDEO ENCODER

(71) Applicant: Apple Inc., Cupertino, CA (US)

(72) Inventors: Peter F. Holland, Los Gatos, CA (US); Guy Cote, San Jose, CA (US); Mark P. Rygh, Union City, CA (US)

(73) Assignee: Apple Inc., Cupertino, CA (US)

( * ) Notice: Subject to any disclaimer, the term of this patent is extended or adjusted under 35 U.S.C. 154(b) by 196 days.

(21) Appl. No.: 14/201,421

(22) Filed: Mar. 7, 2014

(65) Prior Publication Data

US 2015/0255047 A1 Sep. 10, 2015

(51) Int. Cl.

| | |
|---|---|
| ***G09G 5/39*** | (2006.01) |
| ***G09G 5/00*** | (2006.01) |
| ***G09G 5/36*** | (2006.01) |
| ***G09G 5/02*** | (2006.01) |

(52) U.S. Cl.

CPC ..... *G09G 5/39* (2013.01); *G09G 5/001* (2013.01); *G09G 5/363* (2013.01); *G09G 5/022* (2013.01); *G09G 2340/02* (2013.01); *G09G 2340/06* (2013.01); *G09G 2340/10* (2013.01); *G09G 2340/12* (2013.01); *G09G 2360/121* (2013.01); *G09G 2360/128* (2013.01); *G09G 2360/16* (2013.01)

(58) Field of Classification Search

None

See application file for complete search history.

(56) References Cited

U.S. PATENT DOCUMENTS 5,978,029 A * 11/1999 Boice ..... H04N 19/176 375/240.14
6,038,256 A 3/2000 Linzer et al.
6,189,064 B1 * 2/2001 MacInnis ..... G06T 9/00 345/440
6,963,608 B1 * 11/2005 Wu ..... H04N 19/149 375/240.03
7,103,100 B1 * 9/2006 Tsukagoshi ..... H04N 21/4341 375/240.12
2006/0187358 A1 * 8/2006 Lienhart ..... G06F 17/30802 348/661
2010/0271509 A1 * 10/2010 Marumoto ..... H04N 5/765 348/231.99
2011/0102618 A1 * 5/2011 Yamaya ..... H04N 5/23209 348/222.1
2012/0127364 A1 * 5/2012 Bratt ..... H04N 9/67 348/453
2013/0182971 A1 * 7/2013 Leontaris ..... G06T 5/002 382/275
2014/0152778 A1 * 6/2014 Ihlenburg ..... G06T 15/205 348/47

* cited by examiner

*Primary Examiner* — Maurice L McDowell, Jr.

*Assistant Examiner* — Donna J Ricks

(74) *Attorney, Agent, or Firm* — Meyertons, Hood, Kivlin, Kowert & Goetzel, P.C.; Lawrence J. Merkel

(57) ABSTRACT

In an embodiment, a system includes a display processing unit configured to process a video sequence for a target display. In some embodiments, the display processing unit is configured to composite the frames from frames of the video sequence and one or more other image sources. The display processing unit may be configured to write the processed/composited frames to memory, and may also be configured to generate statistics over the frame data, where the generated statistics are usable to encode the frame in a video encoder. The display processing unit may be configured to write the generated statistics to memory, and the video encoder may be configured to read the statistics and the frames. The video encoder may be configured to encode the frame responsive to the statistics.

19 Claims, 6 Drawing Sheets

DISPLAY PIPE STATISTICS CALCULATION FOR VIDEO ENCODER

BACKGROUND

1. Field of the Invention

This invention is related to display frame generation and video encoding.

2. Description of the Related Art

Video sequences are often compressed to reduce bandwidth, transmission latency, memory footprint, and other resource consumption. Other forms of encoding can be implemented as well, such as encryption for security purposes, conversion from one video format to another, etc. A variety of encoding standards exist, including Motion Picture Experts Group (MPEG), H.261, H.262, H.263, H.264, High Efficiency Video Coding (HEVC), Windows Media Video (WMV), etc.

Video sequences include a set of frames that are displayed at a given frame rate (e.g. 15 frames per second (fps), 30 fps, 60 fps, and even 120 fps). Encoding a video sequence frequently includes determining which parts of the frames are changing from frame to frame, detecting redundant information in frames, detecting areas of low "energy" or "entropy" in frames, etc. Accordingly, a variety of statistics may be generated over the frame data to determine various aspects of the encoded video.

When the video encoding is implemented partially or fully in hardware, the generation of the statistics for a given frame frequently occurs in parallel with reading the frame data for the given frame. That is, the frame data is read for encoding and is also processed to generate statistics. Accordingly, determinations as to how to encode the frame (e.g. selecting from among various frame types supported by the encoding system being used) often are required to be made based on incomplete, predicted, or estimated data. In some cases, a less optimal encoding results from the inaccurate statistics that are available for use during the encoding process.

SUMMARY

In an embodiment, a system includes a display processing unit configured to process a video sequence for a target display. In some embodiments, the display processing unit is configured to composite the frames from frames of the video sequence and one or more other image sources. The display processing unit may be configured to write the processed/composited frames to memory, and may also be configured to generate statistics over the frame data, where the generated statistics are usable to encode the frame in a video encoder. The display processing unit may be configured to write the generated statistics to memory, and the video encoder may be configured to read the statistics and the frames. The video encoder may be configured to encode the frame responsive to the statistics.

Because the display processing block may be "ahead" of the encoder in terms of processing a given frame, the display processing unit may generally be exposed to more of the frame data and/or may have more time to process the data than the video encoder may have. Thus, more statistics may be generated and/or processed, permitting a more accurate determination of the frame to encode, in some embodiments.

BRIEF DESCRIPTION OF THE DRAWINGS

The following detailed description makes reference to the accompanying drawings, which are now briefly described.

Figure 1:
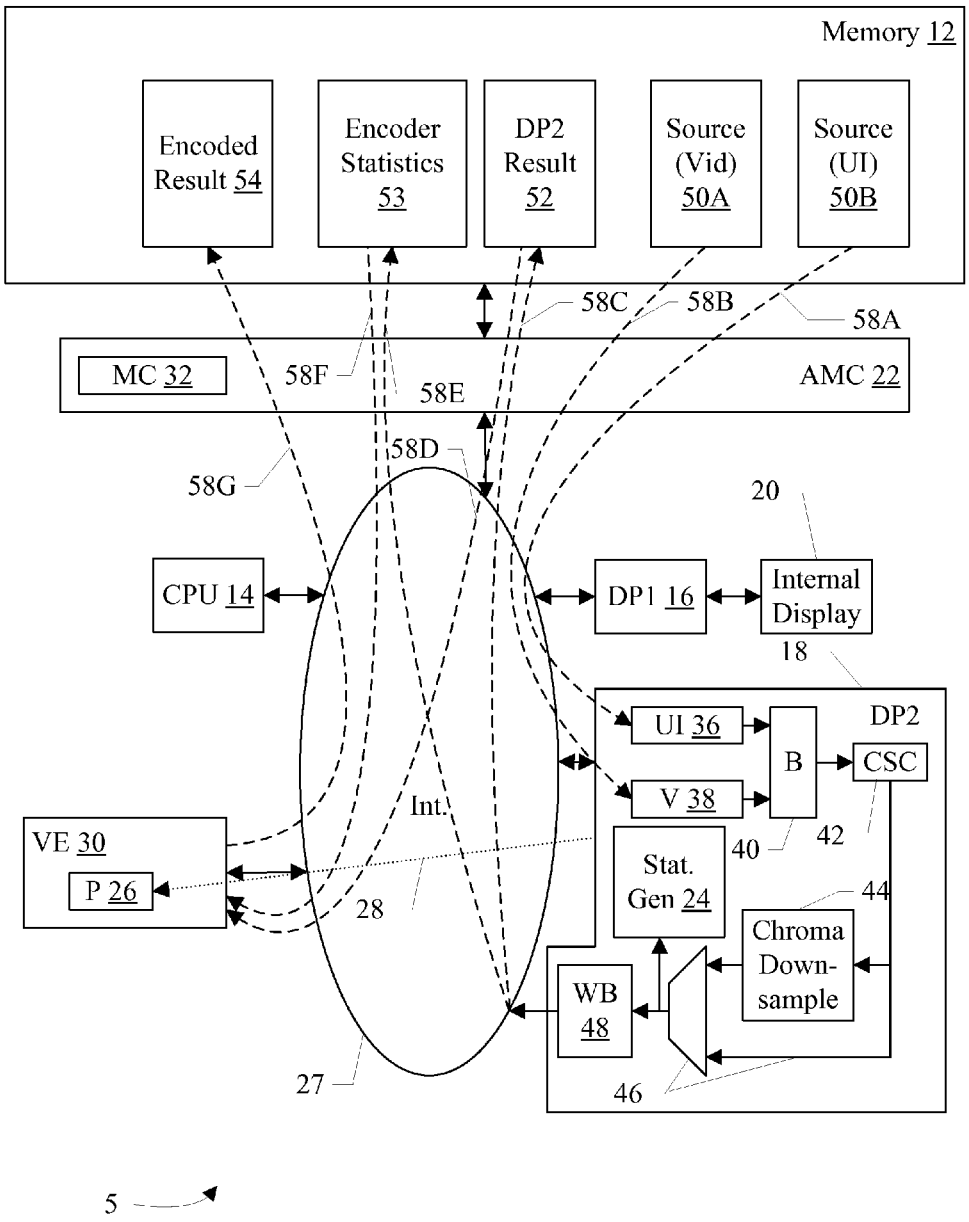
FIG. 1 is a block diagram of one embodiment of a system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. §112, paragraph six interpretation for that unit/circuit/component.

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

DETAILED DESCRIPTION OF EMBODIMENTS

Turning now to FIG. 1, a block diagram of one embodiment of a system 5 is shown. In one embodiment, one or more of the components of the system 5 may be integrated onto a single semiconductor substrate as an integrated circuit "chip" often referred to as a system on a chip (SOC). In other embodiments, the components may be implemented on two or more discrete chips. In the illustrated embodiment, the components of the system 5 that are incorporated into the SOC include a central processing unit (CPU) complex 14, display pipe units 16 and 18, a memory controller 22, a communication fabric or interconnect 27, and a video encoder (VE) 30. The components 14, 16, 18, 22, and 30 may all be coupled to the communication fabric 27. The memory controller 22 may be coupled to a memory 12 during use. Similarly, the display pipe unit 16 may be coupled to a local display 20 during use.

The display pipe unit 16 (or more briefly "display pipe") may be configured to read one or more video sources 50A-50B stored in the memory 12, composite frames from the video sources, and display the resulting frames on the internal display 20. Accordingly, the frames displayed on the internal display 20 may not be directly retained in the system 5 as a result of the operation of the display pipe 16. The display pipe 18, on the other hand, may be configured to read one or more video sources 50A-50B, composite the frames to generate output frames, and may write the output frames to the memory system (e.g. the memory 12, illustrated in FIG. 1 as the DP2 result 52). Accordingly, output frames may be available for further processing in the system 5 (e.g. encoding by the video encoder 30 to produce the encoded result 54). Furthermore, the display pipe 18 may be configured to read different video sources than the display pipe 16 is concurrently reading.

A local display such as internal display 20 may be a display that is directly connected to the system 5 and is directly controlled by the system 5. The system 5 may provide various control signals to the display, including timing signals such as one or more clocks and/or the vertical blanking interval and horizontal blanking interval controls. The clocks may include the pixel clock indicating that a pixel is being transmitted. The data signals may include color signals such as red, green, and blue, for example. The system may control the display in real-time, providing the data indicating the pixels to be displayed as the display is displaying the image indicated by the frame. The interface to the internal display may be, for example, video graphics adapter (VGA), high definition multimedia interface (HDMI), digital video interface (DVI), display port (DP), a liquid crystal display (LCD) interface, a plasma interface, a cathode ray tube (CRT) interface, any proprietary display interface, etc. An internal display may be a display that is integrated into the housing of the system 10. For example, the internal display may include a touchscreen display for a personal digital assistant, smart phone, tablet computer, or other mobile communication device. The touchscreen display may form a substantial portion or even all of one of the faces of such mobile communication devices. The internal display may also be integrated into the lid of the device such as in a laptop or net top computer, or into the housing of a desktop computer. Accordingly, in addition to the hardware circuitry to composite various video sources, the display pipe 16 may include circuitry to generate the local display controls. The display pipes 16 and 18 may be described as having a front end (compositing hardware to produce output frames) and a back end. The back end of the display pipe 16 may generate the control interface to the internal display 20. The back end of the display pipe 18 may include circuitry to write the output frames back to the memory system 12.

The display pipe 18 may not directly drive a display, in the fashion of display pipe 16 as discussed above. Thus, the display pipe 16 may be an example of a display controller, which is configured to read image/video data and drive images to the display based on the data. The display pipe 18, on the other hand, may be an example of a display processing unit. A display processing unit may be configured to read data from one or more video/image sources and composite the images from the video sequences and images to form an output video sequence. The output video sequence may be suitable for display on a given display, or may be an intermediate form that conveys the composited video sequence information so that it can be formatted for a given display at a later point.

The display pipe 18 is shown in greater detail in FIG. 1 to include a user interface processing pipe pipeline (UI pipe) 36, a video processing pipeline (video pipe) 38, a blend unit 40, a color space converter 42, a chroma downsample unit 44, a bypass path 46, a writeback unit 48, and a statistics generator 24. The user interface pipe 36, the video pipe 38 and the blend unit 40 may form the front end of the display pipe 18. The color space converter 42, the chroma downsample unit 44, and the bypass path 46 may be viewed as part of the front end as well. The back end may be the writeback unit 48. The statistics generator 24 may be considered to be part of the front end or the backend, or neither.

The writeback unit 48 may be configured to generate one or more write operations on interconnect fabric 27 to write frames generated by the display pipe 18 to the memory system. The writeback unit 48 may be programmable with a base address of the DP2 result area 52, for example, and may write frame data beginning at the base address as the data is provided from the front end. The writeback unit 48 may include buffering, if desired, to store a portion or all of the frame to avoid stalling the front end if the write operations are delayed, in some embodiments.

Additionally, the writeback unit 48 may be configured to generate one or more write operations on the interconnect fabric 27 to write data generated by the statistics generator 24 to the memory system. The writeback unit 48 may be programmable with a base address of the encoder statistics area 53, for example, and may write data beginning at the base address as the data is provided from the statistics generator 24.

Generally, the statistics generator 24 may be configured to generate any data from the frame data, wherein the generated data may be used by the video encoder 30 to encode the frame. The data generated by the statistics generator 24 may be referred to as "statistics" herein, but may include any desired data. The statistics may, e.g., measure the content of the frame and/or the change between frames. The statistics may be generated over a portion of the frame or all of the frame, or any programmable portion of the frame, in various embodiments. The statistics generator 24, in some embodiments, may further be configured to process the statistics in a manner similar to the processing that would be applied by the video encoder 30. The processed statistics and/or the result of the processing may be written to the encoder statistics area 53.

The statistics generator 24 may be configured to monitor the generated frame data at any point in its processing within the display pipe 18. In the embodiment illustrated in FIG. 1, for example, the statistics generator 24 may be configured to monitor the frame data input to the writeback unit 48. Other embodiments may monitor the output of the blend unit 40, the color space converter, or even the output of the video pipe 38.

In an embodiment, the display pipe 18 may include line buffers configured to store the output composited frame data for reading by the video encoder 30. That is, the video encoder 30 may read data from the display pipe 18 rather than the memory controller 22 in such embodiments. The composited frame data may still be written to the DP result 52 in the memory as well (e.g. for use as a reference frame in the encoding process).

The user interface pipe 36 may include hardware to process a static frame for display. Any set of processing may be performed. For example, the user interface pipe 36 may be configured to scale the static frame. Other processing may also be supported (e.g. color space conversion, rotation, etc.) in various embodiments. The user interface pipe 36 may be so named because the static images may, in some cases, be overlays displayed on a video sequence. The overlays may provide a visual interface to a user (e.g. play, reverse, fast forward, and pause buttons, a timeline illustrating the progress of the video sequence, etc.). More generally, the user interface pipe 36 may be any circuitry to process static frames. While one user interface pipe 36 is shown in FIG. 1, there may be more than one user interface pipe to concurrently process multiple static frames for display. The user interface pipe 36 may further be configured to generate read operations to read the static frame (e.g. video source 50B in FIG. 1). The user interface pipe 36 may thus be an image processing pipeline or an image processing unit.

The video pipe 38 may be configured to generate read operations to read a video sequence source (e.g. video source 50A in FIG. 1). A video sequence may be data describing a series of frames to be displayed at a given display rate (also referred to as a refresh rate). The video pipe 38 may be configured to process each frame for display. For example, in an embodiment, the video pipe 38 may support dither, scaling, and/or color space conversion. In an embodiment, the blend unit 40 may be configured to blend in the red, green, blue (RGB) color space, and video sequences may often be rendered in the luma-chroma (YCrCb, or YUV) color space. Accordingly, the video pipe 38 may support YCrCb to RGB color space conversion in such an embodiment. While one video pipe 38 is illustrated in FIG. 1, other embodiments may include more than one video pipe.

The blend unit 40 may be configured to blend the frames produced by the user interface pipe 36 and the video pipe 38. The display pipe 16 may be configured to blend the static frames and the video sequence frames to produce output frames for display. In one embodiment, the blend unit 40 may support alpha blending, where each pixel of each input frame has an alpha value describing the transparency/opaqueness of the pixel. The blend unit may multiply the pixel by the alpha value and add the results together to produce the output pixel. Other styles of blending may be supported in other embodiments.

In the illustrated embodiment, the display pipe 18 may support a color space conversion on the blended output using the color space conversion unit 42. For example, if the network display is configured to display frames represented in the YCrCb space and the blend unit 40 produces frames represented in the RGB space, the color space conversion unit 42 may convert from RGB to YCrCb. Other embodiments may perform the opposite conversion or other conversions, or may not include the color space conversion unit 42. Additionally, the color space conversion may be supported for other downstream processing (e.g. for the video encoder 30, in this embodiment) rather than for the network display itself.

Some video encoders operate on downsampled chroma color components. That is, the number of samples used to describe chroma components may be less than the number of samples used to describe the luma component. For example, a 4:2:2 scheme uses one sample of luma for every pixel, but one sample of Cb and Cr for every two pixels on each line. A 4:2:0 scheme uses one sample of luma for every pixel, but one sample of Cb and Cr for every two pixels on every alternate line with no samples of Cb and Cr in between. To produce pixels useable by such a video encoder, the chroma downsample unit 44 may be provided to downsample the chroma components. Downsampling may generally refer to reducing the number of samples used to express a color component while retaining as much of the color component as possible. For cases in which the video encoder supports full chroma components, the bypass path 46 may be used to bypass the chroma downsample unit 44. Other embodiments may not include a chroma downsample unit, as desired.

The various processing performed by the display pipes 16 and 18 may generally be referred to as compositing. Compositing may include in processing by which image data from various images (e.g. frames from each video source) are combined to produce an output image. Compositing may include blending, scaling, rotating, color space conversion, etc.

Generally, a frame may be a data structure storing data describing an image to be displayed. The data may describe each pixel to be displayed, in terms of color in a color space. Any color space may be used. A color space may be a set of color components that describe the color of the pixel. For example, the RGB color space may describe the pixels in terms of an intensity (or brightness) of red, green, and blue that form the color. Thus, the color components are red, green, and blue. Another color space is the luma-chroma color space which describes the pixels in terms of luminance and chrominance values. The luminance (or luma) component may represent the brightness of a pixel (e.g. the "black and whiteness" or achromatic part of the image/pixel). The chrominance (or chroma) components may represent the color information. The luma component is often denoted Y and the chrominance components as Cr and Cb (or U and V), so the luma-chroma color space is often referred to as YCrCb (or YUV). When converting from RGB, the luma component may be the weighted sum of the gamma-compressed RGB components, and the Cr and Cb components may be the red component (Cr) or the blue component (Cb) minus the luma component.

The dashed arrows in FIG. 1 may illustrate the movement of data for processing video sources and providing frames to a network display. The display pipe 18 may be configured to read the video sources 50A-50B (and more particularly the user interface pipe 36 may be configured to read the source 50B and the video pipe 38 may be configured to read the source 50A—arrows 58A and 58B, respectively). The resulting output frames may be written to the DP2 result area 52 in the memory 16 by the display pipe 18 (and more particularly the writeback unit 48 may be configured to perform the writes—arrow 58C). The statistics generated over the output frames may be written by the display pipe 18 to the encoder statistics area 53 (and more particularly the writeback unit 48 may be configured to perform the writes—arrow 58E). The video encoder 30 may be configured to read the DP2 result area 52 and the encoder statistics area 53, and may be configured encode the frame, providing an encoded result 54 (arrows 58D and 58F, respectively). Encoding the frame may include compressing the frame, for example, using any desired video compression algorithm. For example, H.264 encoding and/or HEVC encoding may be used. MPEG encoding may be used. H.261, H.262, and/or H.263 encoding schemes may be used. HEVC may be used. Any encoding scheme or schemes may be used in various embodiments. The video encoder may write the encoded result to the memory 12 (encoded result 54, arrow 58G).

The encoded result 54 may be used for a variety of purposes. For example, the encoded result may be processed by a network protocol stack to generate packets for transmission on a network to a network display. In one embodiment, the network protocol stack is implemented in software executed by the processors in the CPU complex 14. Accordingly, the CPU complex 14 may read the encoded result 54, packetize the result, and write the packets to another memory area (not shown). The packetized result may be read by network interface hardware (not shown) for transmission on the network. The encoded result may be stored in non-volatile memory for download and transmission to another device, such as a personal computer, tablet, etc. The encoded result 54 may be decoded for display, through the display pipe 16, to the internal display 20.

It is noted that, while FIG. 1 illustrates various intermediate results in generating the encoded result 54 being stored in the memory 12, some embodiments may store further intermediate results in the memory 12 as well. Furthermore, there may be multiple copies of various results 52, 53, and 54 to allow for overlapped processing (e.g. the results 52, 53, or 54 may be ping pong buffers of two or more sets of data).

The video encoder 30 may include various video encoder acceleration hardware, and may also include a local processor 26 which may execute software to control the overall encoding process. In one embodiment, the display pipe 18 may be configured to generate an interrupt directly to the video encoder 30 (and more particularly to the processor 26) to indicate the availability of frame data in the DP2 result 52 for encoding. That is, the interrupt may not be passed though interrupt controller hardware which may process and prioritize various interrupts in the system 5, such as interrupts to be presented to the processors in the CPU complex 14. The interrupt is illustrated as dotted line 28. The interrupt may be transmitted via a dedicated wire from the display pipe 18 to the video encoder 30, or may be an interrupt message transmitted over the interconnect fabric 27 addressed to the video encoder 30. In some embodiments, the display pipe 18 may be configured to interrupt the video encoder 30/processor 26 multiple times during generation and writing back of a frame to the DP2 result 52, to overlap encoding and generation of the frame. Other embodiments may use a single interrupt at the end of the frame generation. Furthermore, an interrupt may be generated to inform the video encoder 30/processor 26 of the availability of the encoder statistics in the area 53. The statistics may be preprocessed, in some embodiments, dependent on the data generated in a given embodiment. Multiple interrupts may be provided for the encoder statistics as well.

The memory controller 22 may generally include the circuitry for receiving memory requests from the other components of the system 5 and for accessing the memory 12 to complete the memory requests. In the illustrated embodiment, the memory controller 22 may include a memory cache 32 to store recently accessed memory data. In SOC implementations, for example, the memory cache 32 may reduce power consumption in the SOC by avoiding reaccess of data from the memory 12 if it is expected to be read again soon. In mirror mode, the fetches by the display pipe 18 may be placed in the memory cache 32 (or portions of the fetches may be placed in the memory cache 32) so that the subsequent reads by the display pipe 16 may detect hits in the memory cache 32. The interconnect fabric 27 may support the transmission of cache hints with the memory requests to identify candidates for storing in the memory cache 32. The memory controller 22 may be configured to access any type of memory 12. For example, the memory 12 may be static random access memory (SRAM), dynamic RAM (DRAM) such as synchronous DRAM (SDRAM) including double data rate (DDR, DDR2, DDR3, etc.) DRAM. Low power/mobile versions of the DDR DRAM may be supported (e.g. LPDDR, mDDR, etc.).

The memory cache 32 may also be used to store composited frame data generated by the display pipe 18. Since the composited frame data may be read by the video encoder 30 within a relatively short period of time after generation, the video encoder reads are likely to hit in the memory cache 32. Thus, the storing of the composited data in the memory cache 32 may reduce power consumption for these reads and may reduce latency as well. Similarly, the encoder statistics data may be stored in the memory cache 32 and may be read by the video encoder 30, reducing power consumption and/or latency for these reads as well.

Other peripheral hardware may be included in the system 5 as well, in various embodiments. For example, embodiments may include an image signal processor (ISP) configured to receive image sensor data from image sensors (e.g. one or more cameras) and may be configured to process the data to produce image frames that may be suitable, e.g., for display on the local display 20 and/or a network display. Cameras may include, e.g., charge coupled devices (CCDs), complementary metal-oxide-semiconductor (CMOS) sensors, etc.

Peripheral hardware may include a graphics processing unit (GPU) including one or more GPU processors, and may further include local caches for the GPUs and/or an interface circuit for interfacing to the other components of the system 5 (e.g. an interface to the communication fabric 27). Generally, GPU processors may be processors that are optimized for performing operations in a graphics pipeline to render objects into a frame. For example, the operations may include transformation and lighting, triangle assembly, rasterization, shading, texturizing, etc.

Yet another example of exemplary peripheral hardware may be a memory scalar/rotater (MSR) may be configured to perform scaling and/or rotation on a frame stored in memory, and to write the resulting frame back to memory. The MSR may be used to offload operations that might otherwise be performed in the GPU, and may be more power-efficient than the GPU for such operations In general, any of the MSR, the GPU, the ISP 24, and/or software executing in the CPU cluster 14 may be sources for the video source data 50A-50B. Additionally, video source data 50A-50B may be downloaded to the memory 12 from a network, or from other peripherals in the system 5 (not shown in FIG. 1).

Still other peripherals may be included in various embodiments. The peripherals may be any set of additional hardware functionality included in the system 5 (and optionally incorporated in the SOC). For example, the peripherals may include other video peripherals such as video decoders, etc. The peripherals may include audio peripherals such as microphones, speakers, interfaces to microphones and speakers, audio processors, digital signal processors, mixers, etc. The peripherals may include interface controllers for various interfaces external to the SOC including interfaces such as Universal Serial Bus (USB), peripheral component interconnect (PCI) including PCI Express (PCIe), serial and parallel ports, etc. The peripherals may include networking peripherals such as media access controllers (MACs). Any set of hardware may be included.

The CPU complex 14 may include one or more CPU processors that serve as the CPU of the SOC/system 5. The CPU of the system includes the processor(s) that execute the main control software of the system, such as an operating system. Generally, software executed by the CPU during use may control the other components of the system 5 to realize the desired functionality of the system 5. The CPU processors may also execute other software, such as application programs. The application programs may provide user functionality, and may rely on the operating system for lower level device control. Accordingly, the CPU processors may also be referred to as application processors. The CPU complex 14 may further include other hardware such as an L2 cache and/or and interface to the other components of the system 5 (e.g. an interface to the communication fabric 27).

The communication fabric 27 may be any communication interconnect and protocol for communicating among the components of the SOC and/or system 5. The communication fabric 27 may be bus-based, including shared bus configurations, cross bar configurations, and hierarchical buses with bridges. The communication fabric 27 may also be packet-based, and may be hierarchical with bridges, cross bar, point-to-point, or other interconnects.

It is noted that the number of components of the SOC and/or system 5 may vary from embodiment to embodiment. There may be more or fewer of each component than the number shown in FIG. 1.

Figure 2:
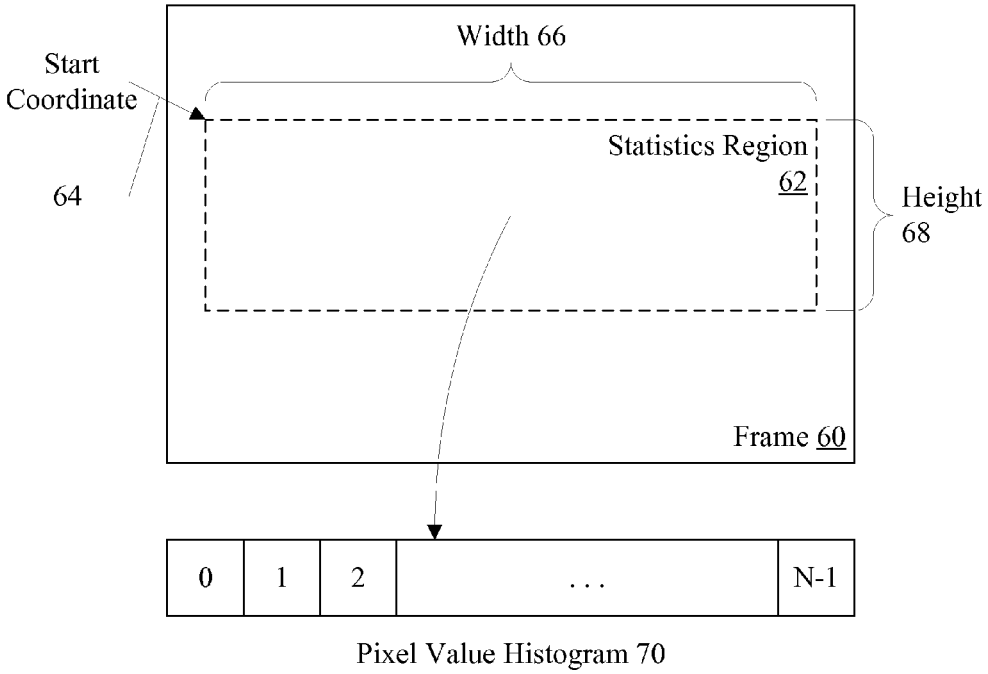
FIG. 2 is a diagram illustrating an exemplary frame and one embodiment of corresponding statistics that may be generated from the frame data.
Figure 3:
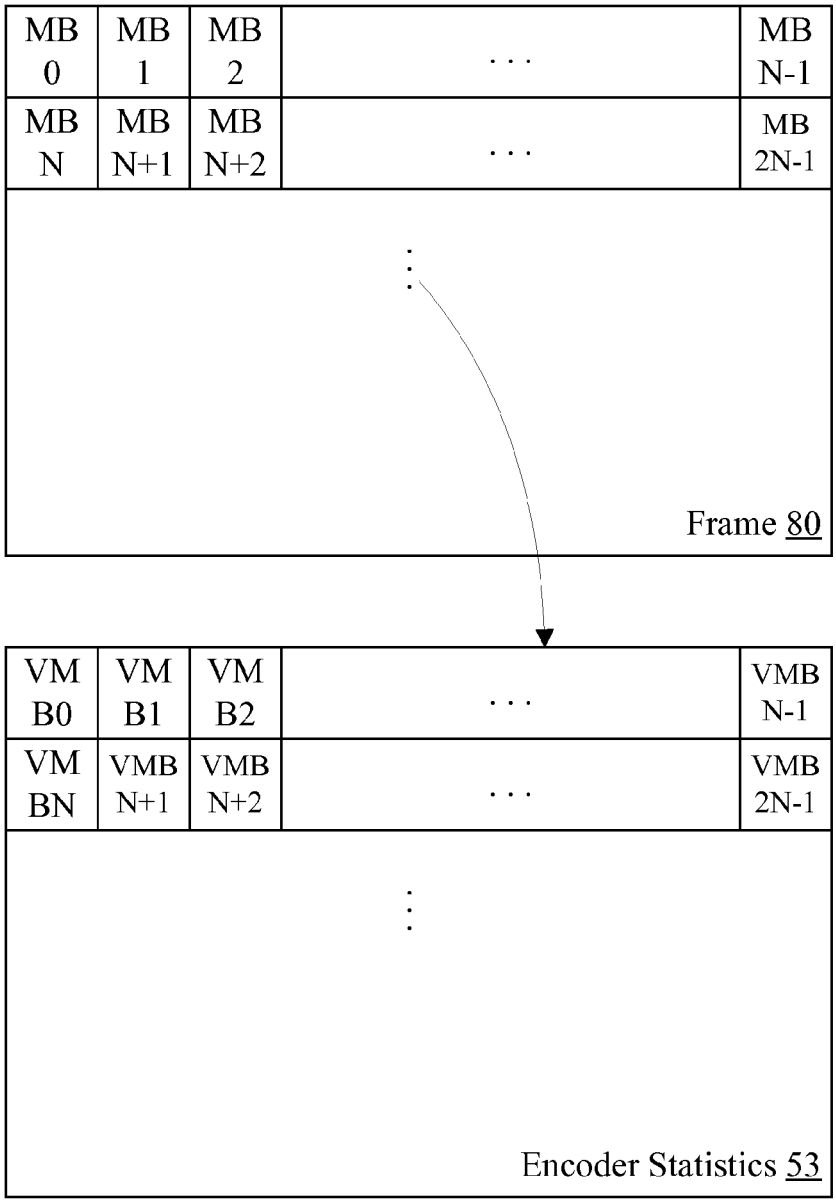
FIG. 3 is a diagram illustrating an exemplary frame and another embodiment of corresponding statistics that may be generated from the frame data.

As mentioned above, the statistics generator 24 may be configured to generate statistics over a portion or all of the data in a frame, for use in encoding the frame in the video encoder 30. Various types of statistics may be generated. FIGS. 2 and 3 are examples of statistics that may be generated, other embodiments may be configured to generate other statistics in addition to, or as an alternative to, the illustrated examples. Generally, the statistics generated may be based on the information used by the video encoder 30 to encode the frame, which may generally be based on the type of encoding to be performed.

FIG. 2 is a first example of statistics that may be generated from a frame 60. In this example, a programmable statistics region 62 may be defined within the frame 60. For example, the statistics region 62 may be defined by a start coordinate 64 within the frame and width and height parameters 66 and 68. Thus, any subset of the frame 60 may be defined as the statistics region 62, including all of the frame 60. Accordingly, the statistics may be generated over the pixels within a portion or all of the frame 60.

Any desired statistics may be generated. In the illustrated embodiment, a histogram 70 of pixel values is used. The histogram 70 may include N "buckets" or counts. Each count may correspond to a range of pixel values. The most significant bits of each pixel value in the region 62 may be used to select a count within the histogram and the count may be incremented to reflect the presence of that pixel value within the region. Thus, for N buckets, the most significant $\log_2(N)$ bits of each pixel value may be used to select a bucket. In one embodiment, pixel values may include multiple components (e.g. RGB or YCrCb), and there may be a histogram 70 for each component.

The histogram may be used to generate parameters for a weighted prediction mechanism in the video encoder 30. These mechanisms may be used, e.g., for H.264 encoding or HEVC encoding.

FIG. 3 is a second example of statistics that may be generated from a frame 80. In this example, the frame 80 is divided into macroblocks (MBs) numbered MB 0, MB 1, etc. The encoder statistics 53 may include one or more values per macroblock. In the illustrated example, the encoder statistics 52 include a variance per macroblock (VMB0, VMB1, etc.). That is, the variance of the pixel values within the macroblock may be generated and written as the statistic for that macroblock. The position of the values within the encoder statistics 53 may indicate the macroblocks to which the values correspond.

The variance may be used to determine a quantization parameter per macroblock, which may be a factor in bit rate allocation (rate control) in the video encoder 30.

While variance is computed in this embodiment, generally any value or values that indicate the information contained within the macroblock may be generated. For example, various measures of the amount of visual information in the macroblock may be generated. Macroblocks in which many pixels are approximately the same value may exhibit low visual information, since the macroblock may be approaching the same color for each pixel. Macroblocks with significant variance in the pixel values may exhibit high visual information.

A macroblock may be an L×M set of pixels within a frame, where L and M are positive integers. L and M may be equal (i.e. the macroblock may be a square) but that is not required. In various embodiments, macroblocks may be 16×16, 8×8, 4×4, etc. Macroblocks smaller and larger than these examples may be used as well.

Figure 4:
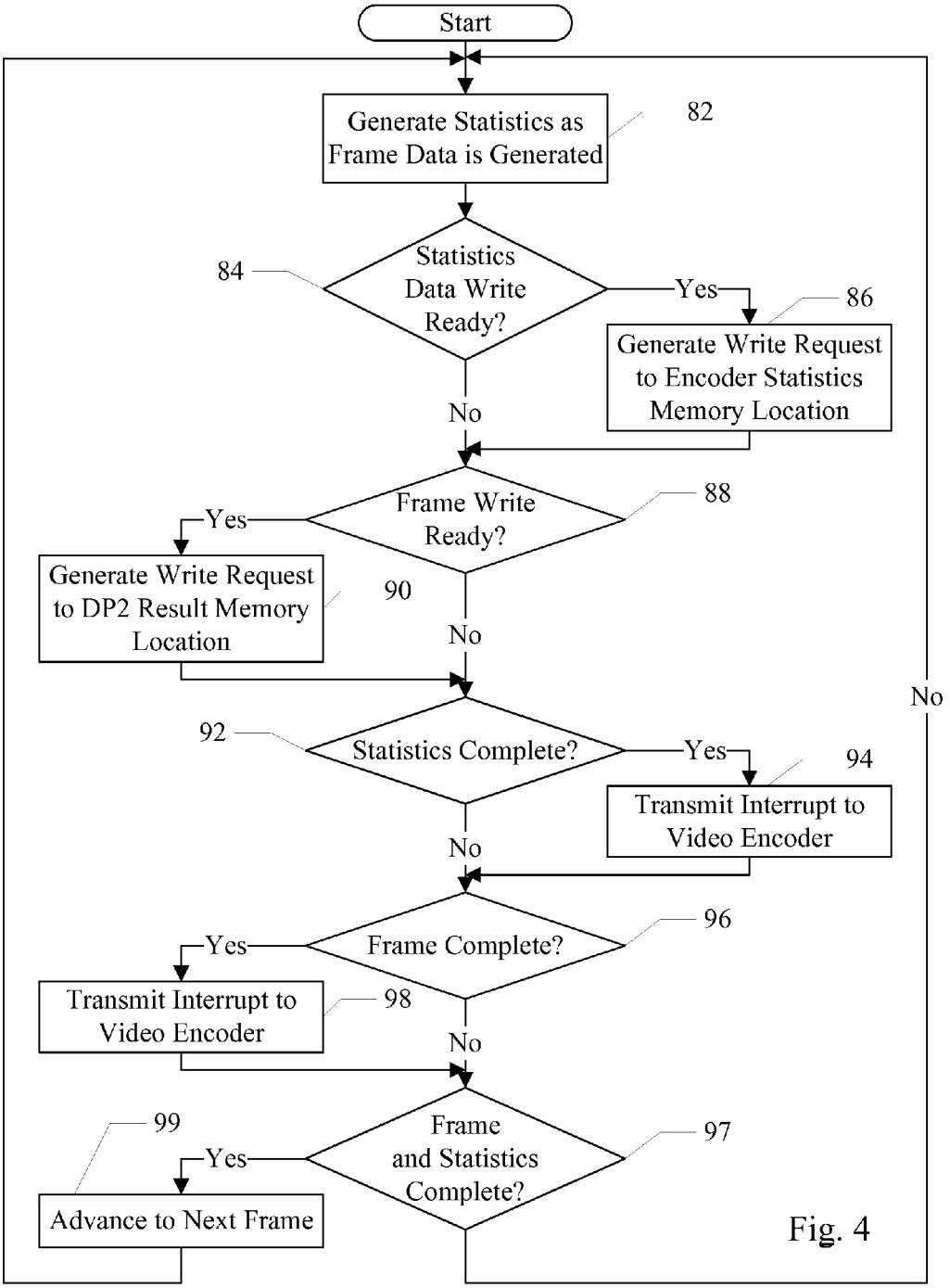
FIG. 4 is a flowchart illustrating operation of one embodiment of a display pipe shown in FIG. 1.

Turning now to FIG. 4, a flowchart is shown illustrating operation of one embodiment of the display pipe 18. While the blocks are shown in a particular order for ease of understanding, blocks may be performed in other orders. Blocks may be performed in parallel by combinatorial logic within the display pipe 18. For example, blocks 82, 84, 88, 92, and 96 may all be performed in parallel in an embodiment. Blocks, combinations of blocks, and/or the flowchart as a whole may be pipelined over multiple clock cycles. The display pipe 18 and/or portions thereof as shown in FIG. 1 and described below, may be configured to implement the operation illustrated in FIG. 4.

The statistics generator 24 may be configured to generate statistics over the frame data as the frame data is generated in the display pipe 18 (block 82). For example, the frame data may be generated by compositing from multiple sources and/or transformed in various fashions such as scaling, color space conversion, downsampling, etc. If the statistics generator 24 has generated enough data to generate a write of the data to memory (decision block 84, "yes" leg), the writeback unit 48 may transmit a write request directed to the encoder statistics memory location 53 (block 86). The data may be accumulated until enough data is available to fill a write transaction, for example. In an embodiment, a cache block size write may be supported, and thus data may be accumulated until a cache block of data has been accumulated (e.g. if macroblock statistics are being generated, as in FIG. 3). Alternatively, in an embodiment similar to FIG. 2, the statistics data may be ready to write when the statistics region 62 has been completely generated and processed by the statistics generator 24.

Similarly, frame data may be accumulated until a frame data write is ready (e.g. a cache block of frame data). If enough frame data has been accumulated for a frame data write (decision block 88, "yes" leg), the writeback unit 48 may transmit a write request directed to the DP2 result memory location 52 (block 90).

If statistics generation is complete (decision block 92, "yes" leg), the display pipe 18 may issue an interrupt to the video encoder 30 (block 94). The interrupt may indicate to the video encoder 30 that the statistics are available to be read. More particularly, the interrupt may differ from the interrupt that may be generated to indicate that the frame is ready, described below. Statistics generation may be viewed as complete if the final write operation has completed to the memory controller 22 (or is globally visible to the video encoder 30). In other embodiments, multiple interrupts may be generated as statistics data becomes available. For example, in embodiments generating macroblock statistics as in FIG. 3, the interrupts may occur as sections of the macroblocks forming the frame have been processed (e.g. after statistics have been generated over half the frame and at completion, after statistics have been generated over each quarter of the frame, etc.).

If the frame is complete (decision block 96, "yes" leg), the display pipe 18 may issue an interrupt to the video encoder 30 (block 98). The interrupt may indicate to the video encoder 30 that the frame available to be read. The frame may be viewed as available if the final write operation has completed to the memory controller 22 (or is globally visible to the video encoder 30). In other embodiments, multiple interrupts may be generated as frame becomes available. For example, the interrupts may occur as sections of the frame have been transmitted (e.g. after half the frame is transmitted and at completion, after each quarter is transmitted, etc.).

Figure 5:
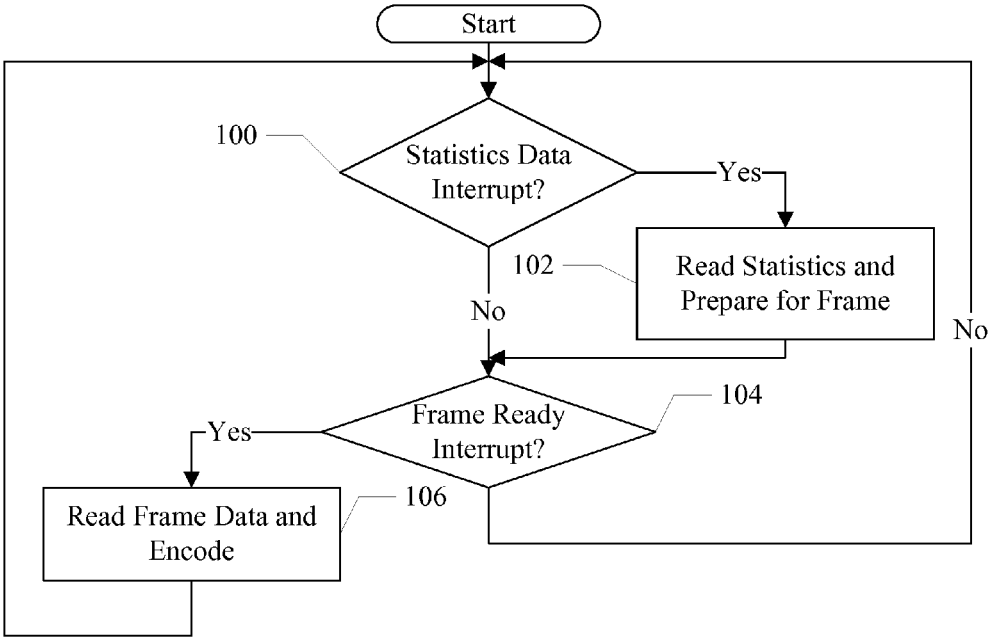
FIG. 5 is a flowchart illustrating operation of one embodiment of a video encoder shown in FIG. 1.

Turning now to FIG. 5, a flowchart is shown illustrating operation of one embodiment of the video encoder 30/processor 26 in response to interrupts from the display pipe 18. While the blocks are shown in a particular order for ease of understanding, blocks may be performed in other orders. Blocks may be performed in parallel by combinatorial logic within the video encoder 30/processor 26. For example, blocks 102 and 104 may be performed in parallel in an embodiment. Blocks, combinations of blocks, and/or the flowchart as a whole may be pipelined over multiple clock cycles. The video encoder 30/processor 26 may be configured to implement the operation illustrated in FIG. 5.

In response to a statistics data interrupt (block 100, "yes" leg), the video encoder 30/processor 26 may read the statistics from the encoder statistics memory location 53 and prepare for the frame (block 102). Preparing for the frame may, e.g., include preprocessing the statistics in some embodiments. In response to a frame read interrupt (decision block 104, "yes" leg), the video encoder 30/processor 26 may read the frame data an encode the frame, writing the result to the encoded result memory location 54 (block 106).

Figure 6:
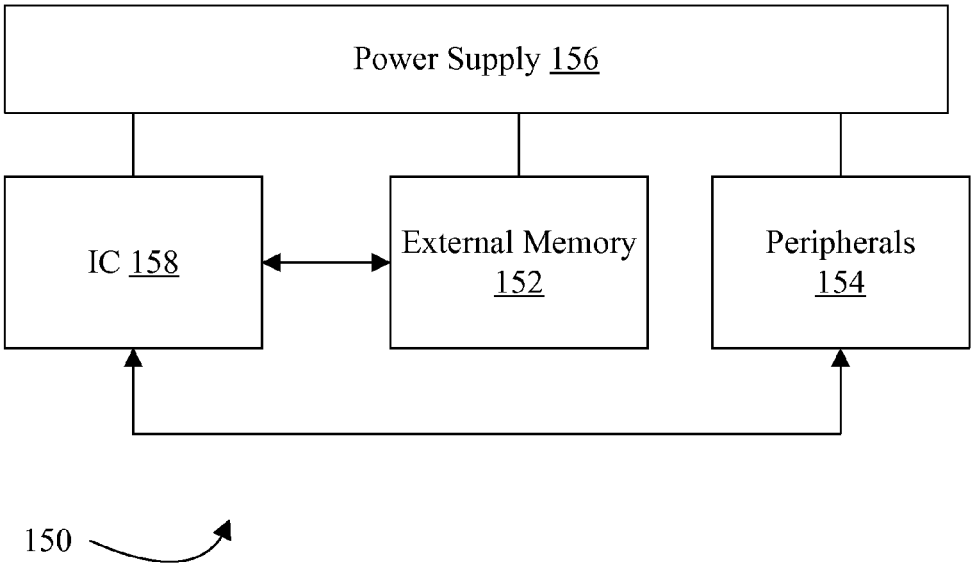
FIG. 6 is a block diagram of an embodiment of a system including the system illustrated in FIG. 1.

Turning next to FIG. 6, a block diagram of one embodiment of a system 150 is shown. In the illustrated embodiment, the system 150 includes at least one instance of an integrated circuit 158 coupled to one or more peripherals 154 and an external memory 152. A power supply 156 is provided which supplies the supply voltages to the integrated circuit 158 as well as one or more supply voltages to the memory 152 and/or the peripherals 154. In some embodiments, more than one instance of the integrated circuit 158 may be included (and more than one memory 152 may be included as well). The IC 158 may be the SOC described above with regard to FIG. 1, and components not included in the SOC may be the external memory 152 and/or the peripherals 154.

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as wifi, Bluetooth, cellular, global positioning system, etc. The peripherals 154 may also include additional storage, including RAM storage, solid state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, net top etc.).

The external memory 152 may include any type of memory. For example, the external memory 152 may be SRAM, dynamic RAM (DRAM) such as synchronous DRAM (SDRAM), double data rate (DDR, DDR2, DDR3, etc.) SDRAM, RAMBUS DRAM, etc. The external memory 152 may include one or more memory modules to which the memory devices are mounted, such as single inline memory modules (SIMMs), dual inline memory modules (DIMM5), etc. Alternatively, the external memory 152 may include one or more memory devices that are mounted on the integrated circuit 158 in a chip-on-chip or package-on-package implementation. The external memory 152 may include the memory 12, in an embodiment.

Numerous variations and modifications will become apparent to those skilled in the art once the above disclosure is fully appreciated. It is intended that the following claims be interpreted to embrace all such variations and modifications.

What is claimed is:

1. A system comprising:

a display processing circuit configured to generate frames of a video sequence, wherein the display processing circuit is further configured to generate one or more statistics over image data in the frames, wherein the one or more statistics are used by a video encoder to aid in encoding the frames, and wherein the one or more statistics are in addition to the image data;

a memory controller coupled to the display processing circuit and configured to couple to a memory through the memory controller, wherein the display processing circuit is configured to write the frames to the memory through the memory controller and further configured to write the one or more statistics to the memory through the memory controller; and the video encoder coupled to the memory controller, wherein the video encoder is configured to read the one or more statistics and the frames from memory and to encode the video sequence responsive to the one or more statistics, and wherein the display processing circuit is configured to transmit a first interrupt to the video encoder responsive to writing the one or more statistics to the memory for a first frame, and wherein the video encoder is configured to read the one or more statistics to prepare for the first frame prior to reading the image data of the first frame, and wherein the display processing circuit is configured to transmit a second interrupt to the video encoder responsive to writing at least a portion of the image data of the first frame to the memory, and wherein the video encoder is configure to read at least the portion of the image data in response to the second interrupt, and wherein the second interrupt is transmitted subsequent to the first interrupt and the video encoder is prepared to encode the first frame by processing the statistics in response to the first interrupt.

2. The system as recited in claim 1 wherein the one or more statistics comprise a histogram of pixel color values within at least a portion of the first frame.

3. The system as recited in claim 2 wherein the histogram is based on a plurality of most significant bits of the pixel color values.

4. The system as recited in claim 2 wherein the histogram is generated over an entirety of the first frame.

5. The system as recited in claim 1 wherein the one or more statistics comprise a value generated for each macroblock in at least a portion of the first frame.

6. The system as recited in claim 5 wherein the value is a variance of the pixels within the macroblock.

7. The system as recited in claim 1 wherein the display processing circuit is configured to transmit a plurality of the second interrupts for the first frame, wherein each interrupt of the plurality of second interrupts is transmitted when a respective portion of the first frame has been written to the memory.

8. An apparatus comprising:

first circuitry configured to provide output frames of a video sequence;

a writeback circuit coupled to the first circuitry and configured to write the output frames to a memory system;

a statistics generation circuit coupled to the writeback circuit and configured to generate one or more values used by a video encoder to encode the video sequence, wherein the writeback circuit is configured to write the one or more values to the memory system, wherein the one or more values are in addition to image data that forms the output frames; and second circuitry configured to transmit a first interrupt to the video encoder responsive to writing the one or more values to the memory system for a first output frame; and the video encoder configured to read the one or more values to prepare for the first output frame prior to reading the image data of the first output frame and wherein the second circuitry is configured to transmit a second interrupt to the video encoder responsive to writing at least a portion of the image data of the first output frame to the memory, wherein the second interrupt is transmitted subsequent to the first interrupt and the video encoder is prepared to encode the first frame by processing the one or more values in response to the first interrupt, and wherein the video encoder is configured to read at least the portion of the image data responsive to the second interrupt.

9. The apparatus as recited in claim 8 wherein the one or more values are a histogram of pixel color values covering at least a portion of the first output frame.

10. The apparatus as recited in claim 8 where the one or more values comprise a plurality of values, each of the plurality of values corresponding to one of a plurality of macroblocks within at least a portion of the first output frame.

11. The apparatus as recited in claim 8 wherein the second circuitry is configured to transmit a plurality of the second interrupts for the first frame, wherein each interrupt of the plurality of second interrupts is transmitted when a respective portion of the first frame has been written to the memory.

12. The apparatus as recited in claim 8 wherein the first circuitry comprises:

a video processing pipeline configured to process input frames of the video sequence;

an image processing pipeline configured to process an image frame; and a blend circuit coupled to the image processing pipeline and the video processing pipeline, wherein the blend circuit is configured to blend the image frame processed by the image processing pipeline and the input frames of the video sequence processed by the video processing pipeline to produce blended frames.

13. The apparatus as recited in claim 12 wherein the first circuitry further comprises a color space converter configured to process the blended frames through a color space conversion, wherein the processed frames received by the writeback circuit are output by the color space converter.

14. A method comprising:

receiving a plurality of frames of a video sequence in a writeback circuit of a display processing circuit;

generating data over the content of a first frame of the plurality of frames by the display processing circuit, the data controlling an encoding of the first frame within an encoded video sequence, wherein the data is in addition to the content of the first frame;

writing the data from the display processing circuit to memory;

generating a first interrupt to a video encoder responsive to writing the data to memory;

writing the first frame from the display processing unit to memory;

reading the data from the memory by the video encoder responsive to the first interrupt;

preparing for the first frame responsive to the data in the video encoder, prior to reading the content of the first frame in the video encoder;

generating a second interrupt to the video encoder responsive to writing at least a portion of the content of the first frame to memory, wherein the second interrupt is generated subsequent to the first interrupt and the video encoder is prepared to encode the first frame by processing the statistics in response to the first interrupt;

reading at least the portion of the content of the first frame responsive to the second interrupt; and encoding at least the portion of the content of the first frame.

15. The method as recited in claim 14 further comprising:

reading the data by the video encoder; and encoding the first frame within the video sequence responsive to the data.

16. The method as recited in claim 14 further comprising:

generating additional data over the content of each frame of the plurality of frames by the writeback circuit as that frame is processed, the data controlling an encoding of that frame within the encoded video sequence;

writing the additional data from the display processing circuit to memory; and writing each frame from the display processing circuit to memory.

17. The method as recited in claim 14 further comprising:

blending frame data from a plurality of sources to produce frames of the video sequence; and color space converting the frame data.

18. The method as recited in claim 17 wherein one of the plurality of sources is a video source and another one of the plurality of sources is a user interface overlay.

19. The method as recited in claim 14 wherein the second interrupt is one of a plurality of second interrupts, each generated responsive to writing a respective portion of the first frame to memory.

* * * * *